US007063431B2

(12) United States Patent
Tsai

(10) Patent No.: US 7,063,431 B2
(45) Date of Patent: Jun. 20, 2006

(54) RESISTIVE BUBBLE LAMP STRUCTURE

(76) Inventor: Ching-Tien Tsai, No. 6., Guang Fu Rd., Erlin Township, Changhua County (TW) 526

( * ) Notice: Subject to any disclaimer, the term of this patent is extended or adjusted under 35 U.S.C. 154(b) by 122 days.

(21) Appl. No.: 10/900,157

(22) Filed: Jul. 27, 2004

(65) Prior Publication Data

US 2005/0036299 A1 Feb. 17, 2005

(30) Foreign Application Priority Data

Jul. 29, 2003 (TW) ..... 92213790 U

(51) Int. Cl.
*F21V 33/00* (2006.01)
*F21V 5/00* (2006.01)
*F21S 4/00* (2006.01)
*H05B 39/00* (2006.01)

(52) U.S. Cl. ..... 362/96; 362/806; 362/318; 315/94

(58) Field of Classification Search ..... 362/242, 362/96, 318, 806; 40/406; 315/94, 95, 97, 315/105

See application file for complete search history.

(56) References Cited

U.S. PATENT DOCUMENTS 2,520,691 A * 8/1950 Otis ..... 313/110
4,070,777 A * 1/1978 Lo Giudice ..... 40/406
6,135,604 A * 10/2000 Lin ..... 362/101
6,464,368 B1 * 10/2002 Chen ..... 362/96
2002/0118531 A1 * 8/2002 Yang ..... 362/96
2003/0112621 A1 * 6/2003 Lee ..... 362/96

* cited by examiner

*Primary Examiner*—Wilson Lee
*Assistant Examiner*—Angela M Lie
(74) *Attorney, Agent, or Firm*—Pai Patent & Trademark Law Firm; Chao-Chang David Pai

(57) ABSTRACT

A resistive bubble lamp structure is disclosed and claimed, which comprises a vacuum glass tube containing liquid $CH_2Cl_2$ with a low boiling point and a circuit mounted at the bottom end of the vacuum glass tube and externally connected to a power supply. The circuit comprises at least one heat-emitting resistive element, which closely surrounds the bottom end of the vacuum glass tube and provides heat to the vacuum glass tube to heat the liquid $CH_2Cl_2$ to its boiling point and generate bubbles therein. The circuit further comprises at least one LED to provide light emissions in various colors at the bottom of the vacuum glass tube. The circuit can be further fitted with an integrated circuit control board to control the light emission of the at least one LED.

8 Claims, 3 Drawing Sheets

RESISTIVE BUBBLE LAMP STRUCTURE

BACKGROUND OF THE INVENTION (a) Technical Field of the Invention

The present invention relates to an improved structure of a resistive bubble lamp, and in particular, to a bubble lamp employing a vacuum glass tube containing a low boiling point liquid, $CH_2Cl_2$. The present invention employs LED to provide colorful light emissions and heat-generating resistive components to provide heat to produce decorative bubbles from the low boiling point liquid.

(b) Description of the Prior Art

In everyday life, decorative lamps are normally used at night for the purpose of producing aesthetic light effects. For example, a bubble lamp is such a decorative night lamp. Generally, the bubble lamp comprises a vacuum glass tube sealed at the top end. The glass tube is filled with a low boiling point liquid, $CH_2Cl_2$, and the bottom end of the glass tube is sealed with a hot light bulb. The top end of the light bulb is tightly in contact with the bottom end of the glass tube so that when the light bulb is electrically connected to a power source, the heat from the light bulb received by the bottom portion of the glass tube will be directly distributed to the liquid within the glass tube, and the heat will instantaneously cause the liquid to reach its low boiling point to produce bubbles within the glass tube. The basic circuit for the prior art bubble lamp is located inside the night light. When an external AC power source is connected through the RC oscillator and bridge transformer, a DC current is provided to the hot light bulb and causes it to light. Alternatively, a DC power source may be applied instead to cause the light bulb to light.

With respect to the above basic night lamp, the light bulb normally uses tungsten which has the drawbacks of low efficiency, high current consumption, short life and high working temperature. Moreover, the color of the light bulb is monochromatic, which only allows gradations of brightness. When the light bulb is used as night lamp light bulb, due to the short life of the light bulb, the efficiency and life of the night lamp are adversely affected. Therefore, the longevity of the light bulb needs further improvement. Further, the light effect generated by the monochromatic light from the light bulb is quite monotonous. In view of the above, there is room for improvement with respect to the light bulb employed in the decorative night lamp.

As a result of rapid development in the materials for use in electronic industries, more durable, portable, and high-efficient LED light bulbs will be available in the future. LED is a light-emitting element made from semiconductor. When current passes through LED, this electronic element will light. The material is from group III-V of the periodic table, for instance, gallium phosphate and gallium arsenate. The light emission is due to conversion of electric energy into light. That is, the semiconductor compound is applied with a current so that electrons and electron holes are combined, and the excessive energy is released in the form of light, thus creating light emission. This is considered as cold light and the life of the LED can be as long as hundreds of thousands of hours. Further, LED is characterized in no idle time, short response time (about $10^{-9}$ second), small volume, low current consumption, low pollution and availability of a plurality of applicable variations in night lamps. If LED is employed in a night lamp together with a bubble light bulb, a more aesthetic lamp with colorful light effects is obtained. However, the working temperature of LED is low and if LED is combined at the bottom end of the bubble lamp, the liquid in the vacuum glass tube of the bubble lamp cannot produce bubbles for decorative purposes.

In view of the above, it is an object of the present invention to provide a resistive bubble lamp structure, which can generate bubbles from the low boiling point liquid as decoration and which is characterized in long operating life, variations in lighting patterns and frequencies, etc. The present invention is expected to be welcomed by consumers.

SUMMARY OF THE INVENTION

The present invention provides a resistive bubble lamp structure, which is characterized in multiple light colors, variations in lighting patterns, and an extended life. In addition, the resistance of the circuit allows the current passing through the circuit to generate heat so that the liquid within the bubble lamp glass tube can reach its boiling point to generate bubbles for decorative purposes.

The bubble lamp structure comprises a vacuum glass tube containing liquid $CH_2Cl_2$ with a low boiling point, and a circuit mounted at the bottom end of the vacuum glass tube and externally connected to a power supply. The circuit comprises at least one heat-emitting resistive element, which closely surrounds the bottom end of the vacuum glass tube and provides heat through the vacuum glass tube to the liquid inside when electrical current is passed through the circuit. The heat thus received by the liquid provides sufficient heat to heat the liquid to its boiling point and generate bubbles. The circuit also includes at least one LED, which provides light emissions in various colors when electrical current is passed through the circuit. Thus, the colorful light emissions in combination with the movement of the bubbles inside the vacuum glass tube create aesthetic light effects for decorative purposes. In addition, an integrated circuit control board can also be added to the circuit to control the actuation or operation of the circuit through a program design on the integrated circuit control board so as to control the lighting patterns of the at least one LED.

The foregoing summary provides only a brief introduction to the present invention. To fully appreciate the present invention, the following detailed description of the invention and the appended claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings, in which a preferred structural embodiment incorporating the principles of the present invention is shown by way of illustrative examples.

DETAILED DESCRIPTION OF THE PREFERRED EMBODIMENT

The preferred embodiments of the present invention are described in the following along with the drawings. They are not intended to limit the scope, applicability or configuration of the invention in any way. Rather, the following description provides a convenient illustration for implementing the present invention. Various changes to the described embodiments may be made in the function and arrangement of the elements described without departing from the scope of the invention as set forth in the appended claims.

Figure 1:
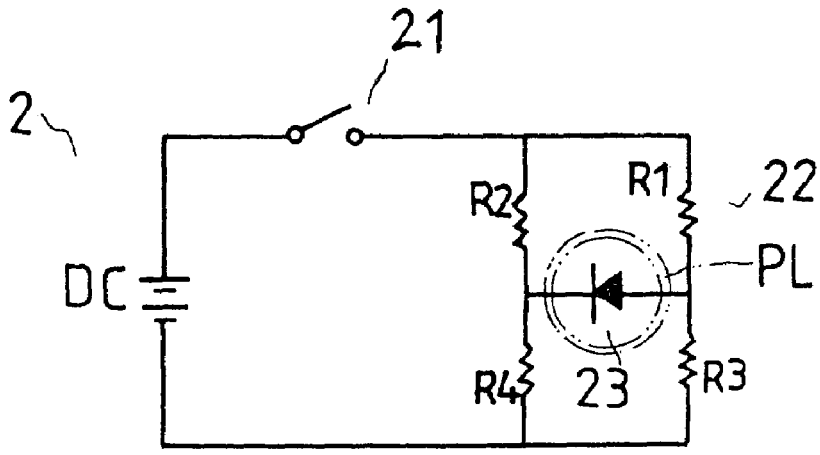
FIG. 1 is a schematic view showing the circuit design for the bubble lamp in accordance with the present invention.

FIG. 1 shows a circuit design for the bubble lamp structure of the present invention, wherein the bubble lamp employs a vacuum glass tube PL containing a low boiling point liquid, $CH_2Cl_2$, and functions as decorative lighting. The lower section of the bubble lamp glass tube PL is mounted over a circuit 2 which is externally connected to a direct current structure DC linked to a control switch 21—the configuration of the control switch 21 can be changed as necessary, for instance, a sound control switch or a light control switch). The bottom end (shown as dotted line) of the glass tube PL is closely surrounded with at least one element which can emit heat due to its electrical resistivity to passage of an electric current through it. In the present embodiment, four resistances 22 are used (constituted of $R_1$, $R_2$, $R_3$, and $R_4$). When a current is passed through the circuit 2, a light of a certain color is generated from LED 23. The four resistances 22, when a current is passed through them, will reach a working temperature and become a heat source around the bottom end of the bubble lamp glass tube PL so that the $CH_2Cl_2$ generates a vapor. The entire structure is in combination with a durable LED and to form a resistive bubble lamp structure.

Figure 2:
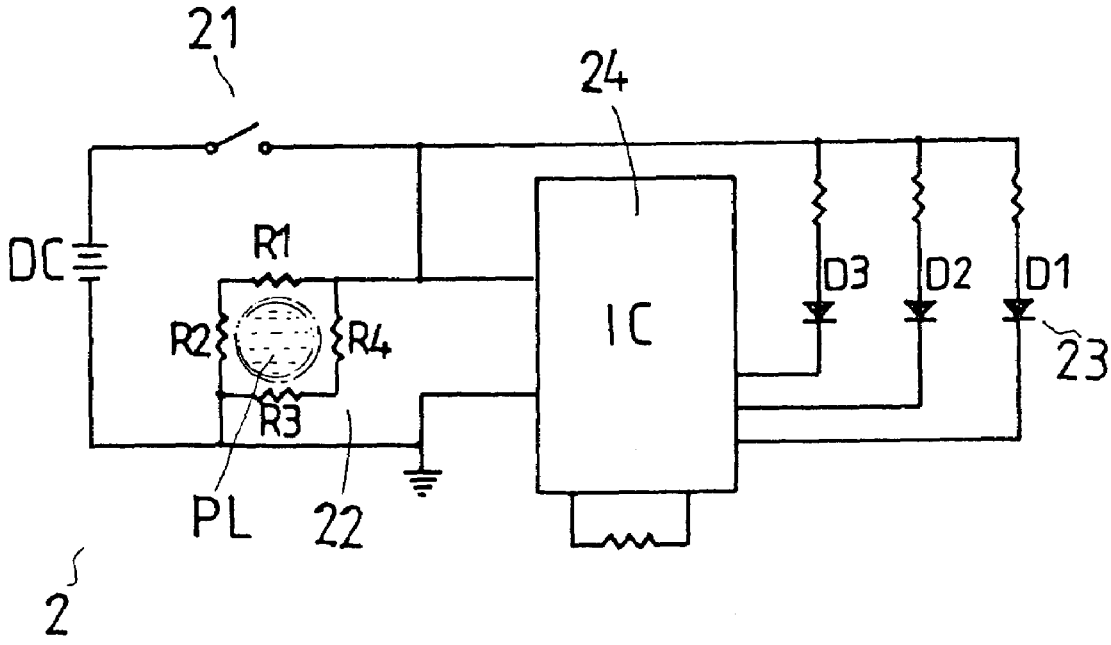
FIG. 2 is a schematic view showing a variation of the circuit design for the bubble lamp structure in accordance with the present invention.

FIG. 2 shows a circuit design which enables the bubble lamp to produce different types of light effect. Due to the small volume of material for LED 23, a plurality of LEDs (e.g. D1, D2, and D3) can be mounted in a limited space within the circuit 2. The bubble lamp glass tube PL can be combined with the circuit 2 which also includes an integrated circuit control board 24. When the power source is ON, the program of the integrated circuit control board 24 causes the LED 23 to flicker, light steadily or display various color-changing effects. The four resistances 22 must be mounted around the bottom end of the bubble lamp glass tube PL to obtain the working temperature for the bubble lamp glass tube PL.

Figure 3:
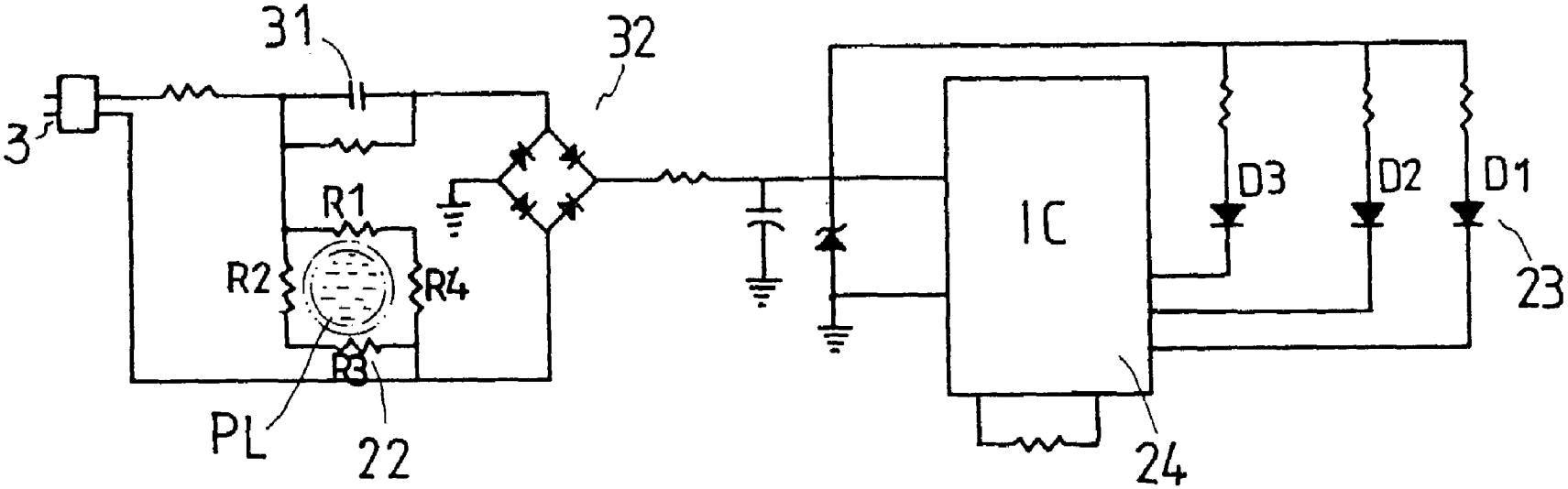
FIG. 3 is a schematic view showing another variation of the circuit design for the bubble lamp structure in accordance with the present invention.

Referring to FIG. 3, in order to accommodate different types of externally connected power sources, the AC structure 3 connected to the bubble lamp glass tube PL can be an AC power source, which provides current via RC oscillator 31, bridge rectifier 32 together with four resistances 22 to LED 23. The integrated circuit control board 24 is also included to control the light signals. Thus, with different input voltages, the bubble lamp glass tube PL employs the working heat energy from the four resistances 22 ($R_1$, $R_2$, $R_3$, and $R_4$) to generate bubbles, while variations of light effect can be achieved.

Figure 4:
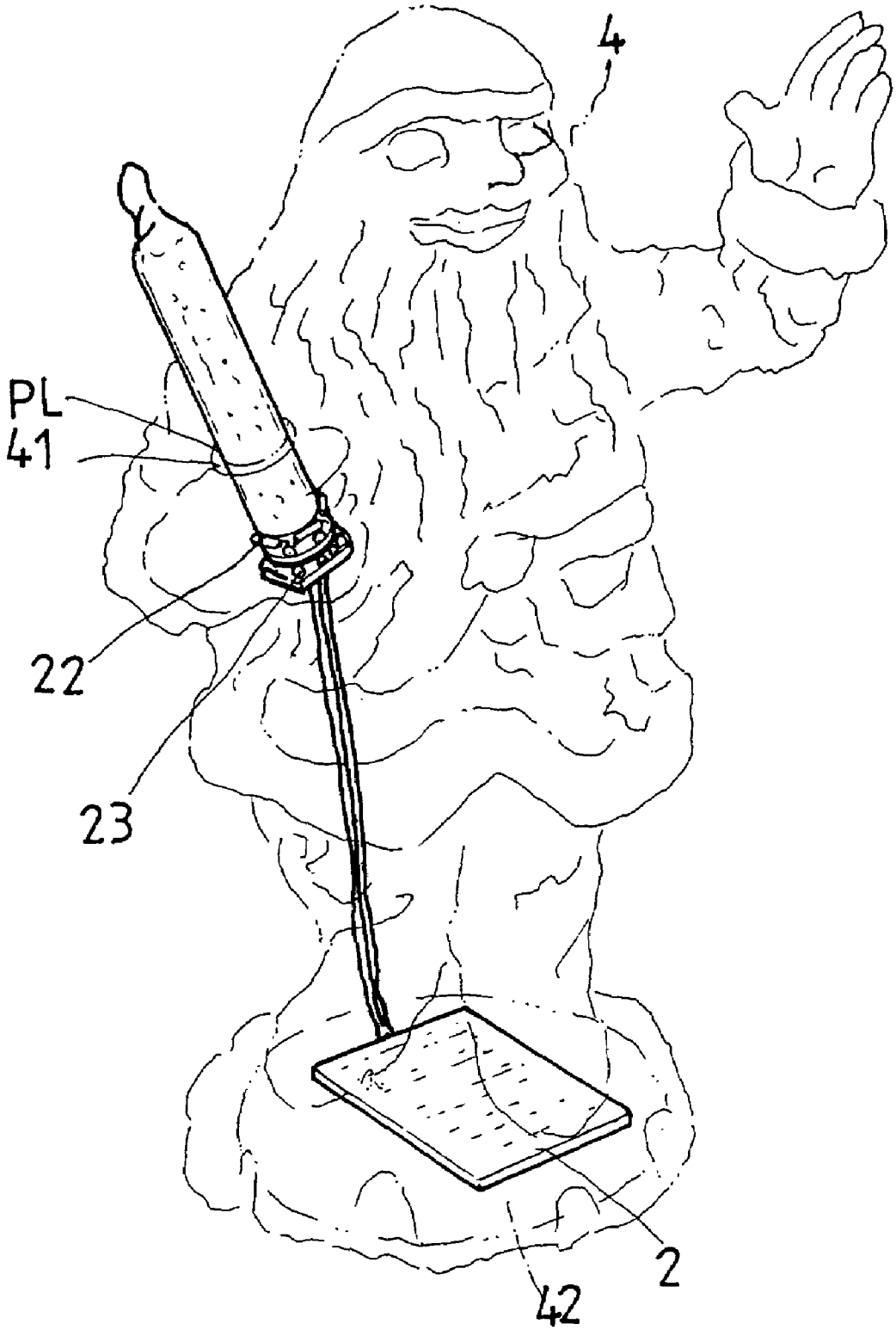
FIG. 4 is a schematic view showing the bubble lamp structure in accordance with the present invention being employed in Christmas decorative lighting.

As shown in FIG. 4, there is shown an actual application of the bubble lamp in accordance with the present invention. The bubble lamp glass tube PL is used in combination with a Christmas decorative light seat 4. An inlet hole 41 at an appropriate position of the lamp seat 4 is provided for the engagement with the bubble lamp glass tube PL. The bottom end of the tube PL is wrapped with the four resistances 22 and aligned with the LED 23. In addition, a cavity 42 in the light seat 4 is provided for the mounting of the circuit 2 connecting to the four resistances 22 and LED 23 to form a closed circuit path. When in application, the LED 23 at the bottom section of the glass tube PL generates lights in multiple colors, at variable frequencies, and the four resistances 22 heat the bottom end of the bubble lamp glass tube PL to cause the air bubbles to move around. The variation in light colors together with the movement of the bubbles provides a best visual effect. Similarly, the bubble lamp structure can be easily adapted for or used with various decorative items (hanging or free-standing) and night lights.

In accordance with the present invention, the advantages of the resistive bubble lamp structure are as follows:

(1) The LED of the bubble lamp structure is characterized in rapid light output response, small volume, low current consumption, low pollution and long life. Further, it provides multiple colors to be selected for variations so that the bubble lamp is more colorful when used as a decorative lamp.

(2) With the combination of LED with the integrated circuit control board, the operation of the circuit can be controlled via the program design of the IC control board so that the light can be either flickering, steady (bright or with various light effects), making the bubble lamp an attractive decorative light.

(3) With the circuit design of the present invention, at least one resistance is used to generate heat energy when current passes through the resistance. The bottom end of the glass tube which receives working energy generated by the resistance causes the liquid to reach the boiling point to generate bubble as decoration. Since the resistance is simply a heat-emitting element when a current is passed through it, a number of electronic components may be used for that purpose, for instance, cement resistance, electric thermal wire, electric-thermal plate, etc. In other words, a wide selection of the materials is possible for the resistances used in this invention.

(4) The power source for the resistances and LED can be an externally connected DC type or AC type.

(5) Since the bubble lamp and the LED are separable, they can be easily mounted to a lamp seat of any configuration provided with an inlet hole and a cavity. The glass tube and the resistance can be correspondingly mounted into the inlet hole and then linked to the remainder of the circuit within the cavity.

When compared to conventional night lamps and bubble lamps, the present invention provides enhanced color variations and aesthetic effect. Moreover, the movement of the bubbles through the use of resistance further provides an improvement over the prior art design.

It will be understood that each of the elements described above, or two or more together may also find a useful application in other types of methods differing from what is described above.

While certain novel features of this invention have been shown and described and are pointed out in the annexed claim, it is not intended to limit the invention to the details above, since it is understood that various omissions, modifications, substitutions and changes in the forms and details of the device illustrated and in its operation can be made by those skilled in the art without departing in any way from the spirit of the present invention.

I claim:

1. A resistive bubble lamp structure, comprising:

a vacuum glass tube containing liquid $CH_2Cl_2$ with a low boiling point, and a circuit mounted at the bottom end of the vacuum glass tube and externally connected to a power supply, said circuit comprising at least one heat-emitting resistive element, which closely surrounds the bottom end of the vacuum glass tube and, when electrical current is passed through the circuit, provides heat to the vacuum glass tube to heat the liquid $CH_2Cl_2$ to its boiling point and generate bubbles therein, and at least two light-emitting diodes (LED), which provide light emission in various colors when electrical current is passed through the circuit.

2. The resistive bubble lamp structure of claim 1, wherein the at least one heat-emitting resistive element is an electric-thermal wire.

3. The resistive bubble lamp structure of claim 1, wherein the at least one heat-emitting resistive element is an electric-thermal plate.

4. The resistive bubble lamp structure of claim 1, wherein the at least one heat-emitting resistive element is a cement resistance.

5. The resistive bubble lamp structure of claim 1, wherein the externally connected power supply is provided with a control switch.

6. The resistive bubble lamp structure of claim 1, wherein the circuit further comprises an integrated circuit control board, which controls the actuation or operation of the circuit through a program design on the integrated circuit control board so as to control the light emission of the at least one LED.

7. The resistive bubble lamp structure of claim 1, wherein the externally connected power supply is an AC supply which via a RC oscillator and a bridge rectifier supplies DC to the circuit.

8. The resistive bubble lamp structure of claim 1, wherein the externally connected power supply is a DC supply.

* * * * *